United States Patent [19]

Moretti et al.

[11] 4,367,765

[45] Jan. 11, 1983

[54] FLOW REGULATOR FOR HYDRAULIC CIRCUITS

[75] Inventors: Luciano Moretti, Turin; Giulio Dotti, Milan, both of Italy

[73] Assignee: Centro Ricerche Fiat S.p.A., Strada Torino, Italy

[21] Appl. No.: 221,628

[22] Filed: Dec. 31, 1980

[30] Foreign Application Priority Data

Jan. 8, 1980 [IT] Italy ..... 67018 A/80

[51] Int. Cl.[3] ..... F15B 13/02

[52] U.S. Cl. ..... 137/881; 91/461; 137/117; 137/596.12; 137/885

[58] Field of Search ..... 91/461; 137/117, 596.12, 137/596.13, 881, 885

[56] References Cited

U.S. PATENT DOCUMENTS 3,902,401 9/1975 Allen et al. ..... 91/461 X 4,121,610 10/1978 Harms et al. ..... 137/117

*Primary Examiner*—Gerald A. Michalsky

*Attorney, Agent, or Firm*—Frost & Jacobs

[57] ABSTRACT

The regulator is designed to control the flow of a pressurized fluid between a source of said fluid which feeds it at a feed pressure, and a user device in which the fluid is at a utilization pressure which depends on the operating conditions of the device; the regulator also comprises a valve element mobile in the direction of its axis and arranged to vary the degree of closure of an orifice between a feed chamber and a utilization chamber, and a first and second cavity in which there is housed a first and second active surface respectively, on one of which there acts the utilization pressure and on the other of which there acts a control pressure arranged to control the movement of the valve element.

10 Claims, 5 Drawing Figures

FLOW REGULATOR FOR HYDRAULIC CIRCUITS

BACKGROUND OF THE INVENTION

This invention relates to a flow regulator for hydraulic circuits, which is designed to control the flow of a fluid between a source which feeds it at a feed pressure, and a user device in which the fluid is at a utilisation pressure which depends on the operating conditions of said device.

The regulator according to the invention is able both to continuously control the flow towards the user device without energy losses being produced consequent on the discharge of high pressure fluid flows, and to prevent too high overpressures being generated in the circuit, which could cause damage.

Flow regulation in known hydraulic systems (for example for controlling the equipment of earth moving machines, tractors or the like), is attained by varying the degree of closure of the delivery port of a slide valve, and discharging the excess fluid through a pressure relief valve. This latter valve is normally kept in its rest position, in which it completely closes the passage port between the feed chamber and discharge, by resilient means, and the valve is made to open when the fluid pressure on an active face thereof exceeds the set value of the force generated by said resilient means, so opening the valve.

In regulators of this type, there is a serious drawback due to the fact that the fluid which acts on the said active surface of the valve, and of which the pressure can be very high depending obviously on the maximum utilisation pressure, is fed to discharge so dispersing a rather high quantity of energy.

SUMMARY OF THE INVENTION

The object of the present invention is to provide a flow regulator of the aforesaid type which is free from the described drawback.

The invention provides a flow regulator designed to control the flow of a pressurised fluid between a source of said fluid which feeds it at a feed pressure, and a user device in which said fluid is at a utilisation pressure which depends on the operating conditions of the device, comprising a discharge valve arranged to open and to feed towards discharge at least part of said fluid from said source when the difference between said feed pressure and said utilisation pressure exceeds a given value, characterised by comprising a valve element mobile in the direction of its axis and arranged to vary the degree of closure of an orifice between a feed chamber and a utilisation chamber of said regulator and kept normally by the action of a spring in a rest position in which it closes said port, said feed and utilisation chambers being in communication respectively with said fluid source and said user device, and further comprising a first and second cavity in which a first and a second active surface of said valve element are respectively housed, each of which is arranged to sense a pressure acting on it and to determine a corresponding movement of the valve element, said first cavity being in communication with said utilisation chamber by way of a first duct in order to cause said utilisation pressure to act on said first active surface of the valve element, and said second cavity being in communication with said feed chamber by way of a second duct, said first and second duct being in communication with each other by way of a third duct, in which there is disposed an interception member arranged to continuously vary the fluid flow through said third duct, said feed chamber and said second duct being in communication with each other by way of a bore of predetermined size which is arranged to reduce the pressure of said fluid passing from said feed chamber to said duct, the degree of closure of the orifice between said feed chamber and said utilisation chamber being varied by adjusting said interception member in order to vary the fluid flow through said third duct and thus generate in said second duct a control pressure which is transmitted to said second cavity and to said second active surface in order to consequently move said valve element.

BRIEF DESCRIPTION OF THE DRAWINGS

The regulator according to the present invention will be more apparent from the description given hereinafter of one embodiment thereof, with reference to the accompanying drawings in which.

DETAILED DESCRIPTION OF THE INVENTION

Figure 1:
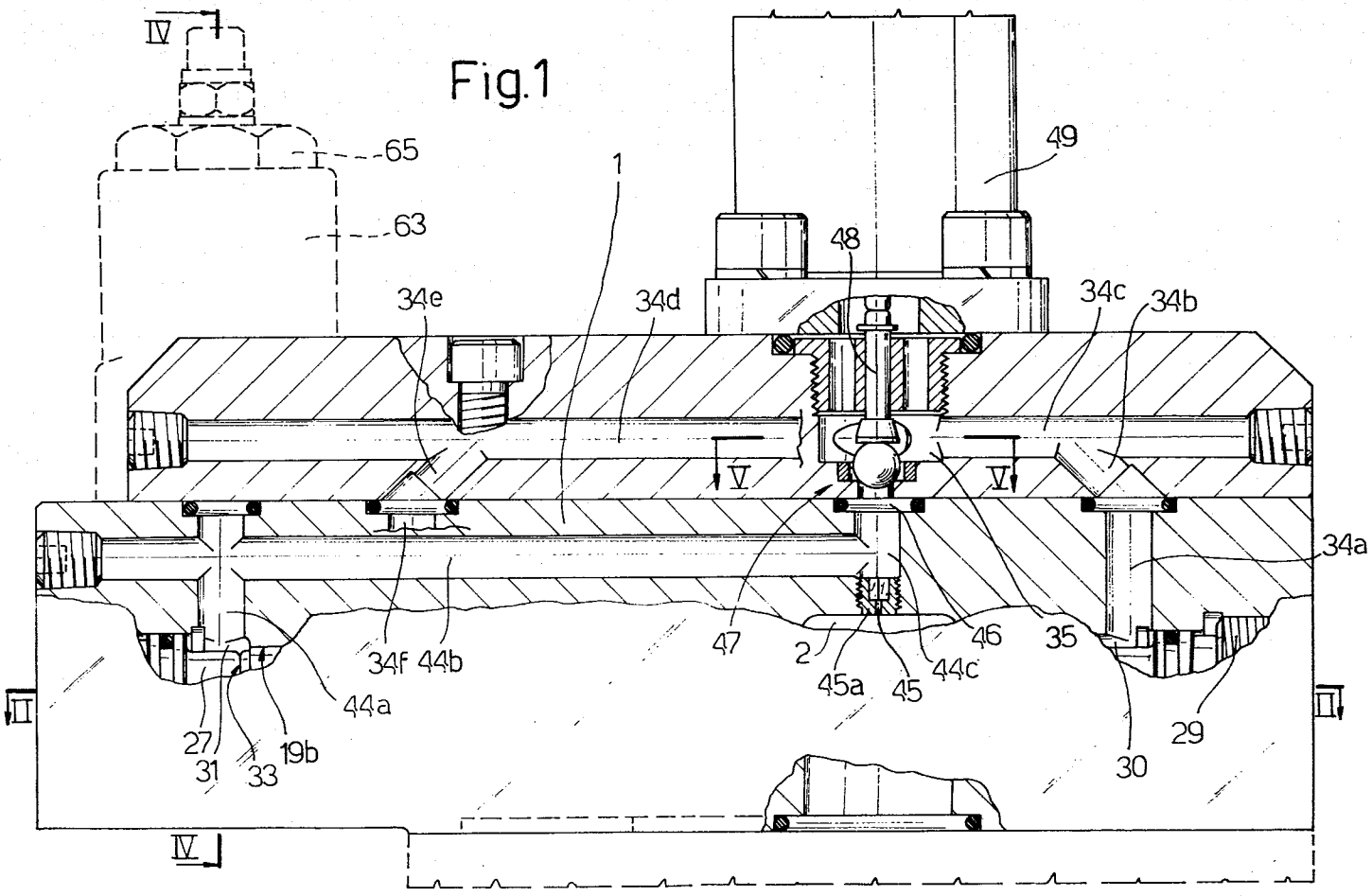
FIG. 1 is a partly sectional side view of the regulator according to the invention.

The flow regulator according to the invention is designed to control the flow of a pressurised fluid between a fluid source (not shown) which feeds it at a feed pressure which depends on the utilisation pressure, and a user device (not shown) in which said fluid acts at a utilisation pressure which depends upon the operating conditions of the device.

The device comprises substantially a body 1 (FIG. 2) in which there is provided a feed chamber 2 for connection by way of a suitable bore to said pressurised fluid source, and a utilisation chamber 4 (FIG. 2) for connection to the user device (by way of ducts, not shown).

In said body there is provided a discharge chamber 5 for connection to a discharge tube by way of ducts, not shown. Between the feed chamber 2 and discharge chamber 5 there is disposed a discharge valve indicated overall by 6, comprising a substantially cylindrical valve element 7 mobile axially in a corresponding bore 8 in the body 1, and provided with a conical surface 9 arranged to cooperate with a corresponding seat provided in a bushing 10 of diameter equal to that of the bore 8, and in communication with the feed chamber 2.

Figure 2:
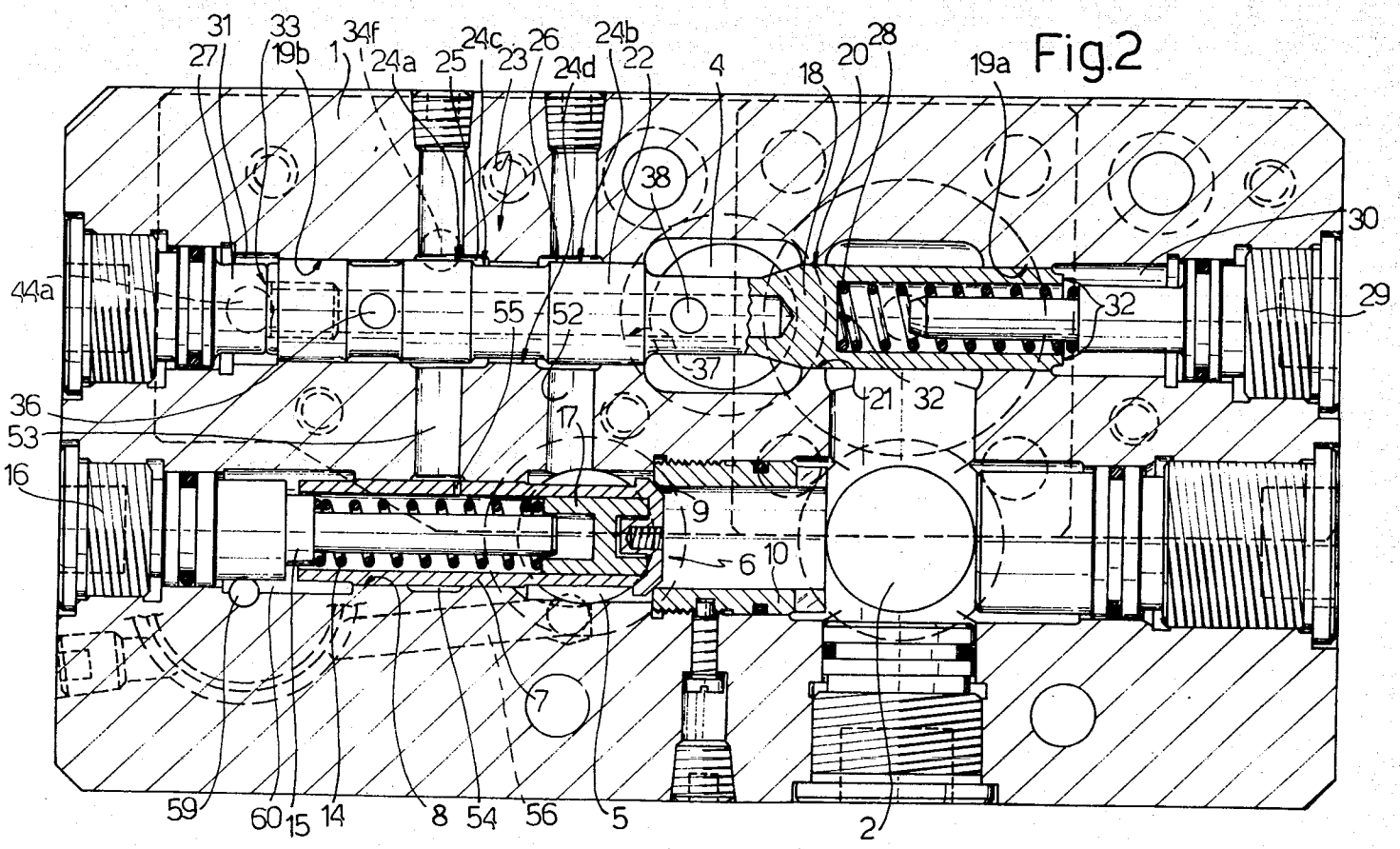
FIGS. 2 and 3 are sections through the regulator of FIG. 1 on the line II—II, in two different operating positions.

Said valve is normally kept in its closed position, shown in FIG. 2, by the action of a spiral spring 14, one end of which rests on a corresponding shoulder of a stem 15 fixed to the body 1 by means of an end plug 16, and the other end of which rests on a socket 17 disposed in the valve element 7.

The regulator also comprises a valve element 18 provided with a substantially cylindrical active surface 20 arranged to close an orifice 21 between the feed chamber 2 and utilisation chamber 4. The valve element 18 is formed on a substantially cylindrical stem 22 mobile in the direction of its longitudinal axis in the bores **19*a*, 19*b* of the body 1. A slide valve indicated overall by 23 and provided with a pair of active cylindrical surfaces 24***a*, 24*b* separated by a surface of smaller diameter 24*c* is rigid with this stem, and is arranged to cooperate with annular chambers 25, 26 of the body 1. Between said chambers, a cylindrical surface 24*d* having a diameter greater than that of the surface 24*c* (which lies between the surfaces 24*a*, 24*b* of the stem 22), defines with this latter a substantially annular compartment which puts the chambers 25 and 26 into communication.

The stem 22 is kept in its left hand end-of-stroke position, shown in FIG. 2, substantially against an end plug 27, by the action of a spiral spring 28 housed in a bore provided in the right hand end of the stem. One end of this spring rests on the base of said bore, while the other end rests on a corresponding shoulder of another plug 29 rigid with the body 1. In said end-of-stroke position, the active surface 20 of the valve element 18 closes the orifice 21 between the feed chamber 2 and utilisation chamber 4, as can be clearly seen in FIG. 2.

In the body 1 there are also provided a first and second cavity indicated respectively by 30 and 31, into each of which there opens a corresponding end of the stem 22. A first and second active surface of the stem, 32 and 33, respectively bound the cavities 30 and 31 so that the pressure in each of these cavities is transmitted to the relative active surface in order to control the axial movement of the stem 22 in the manner explained hereinafter.

Figure 3:
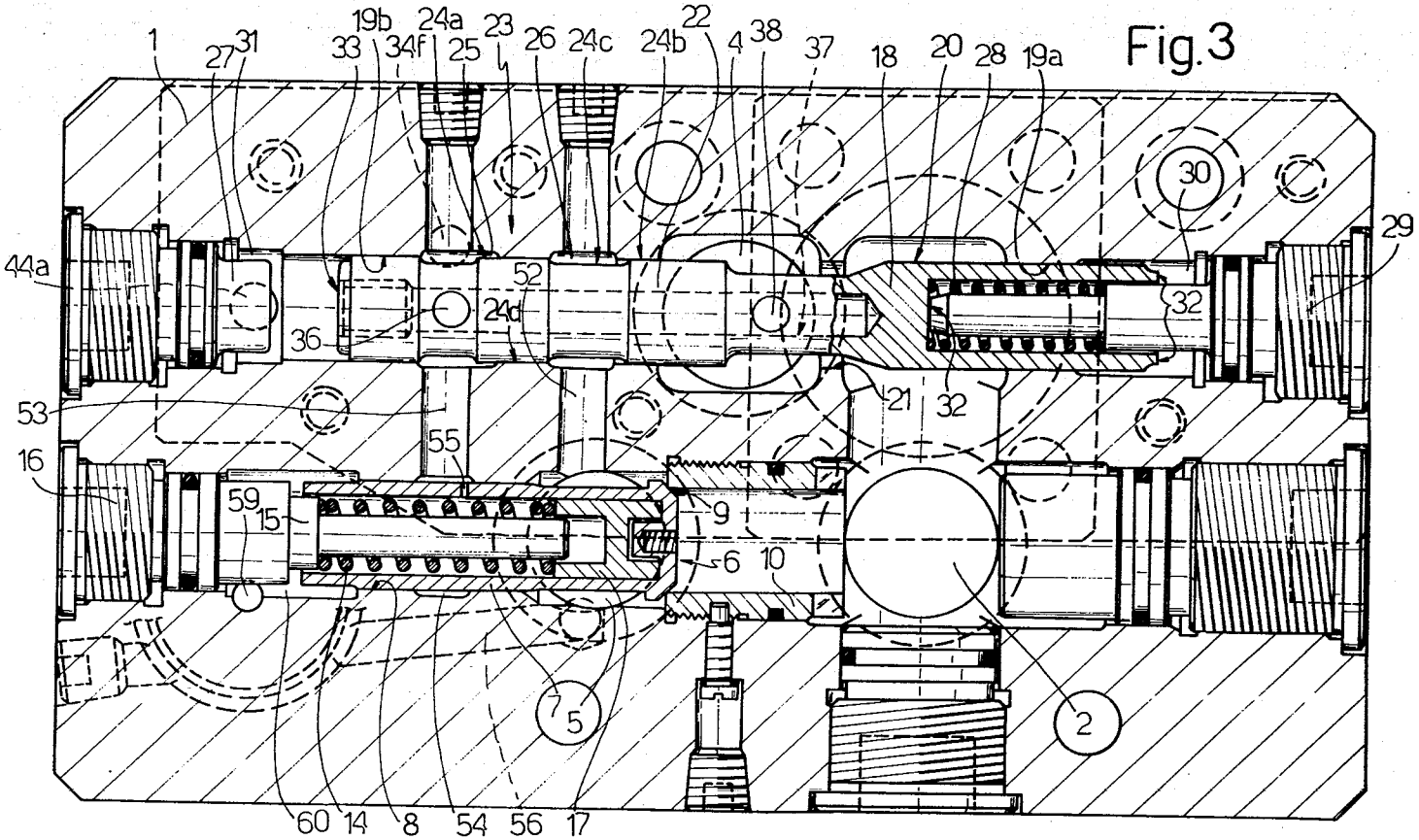
Figure 5:
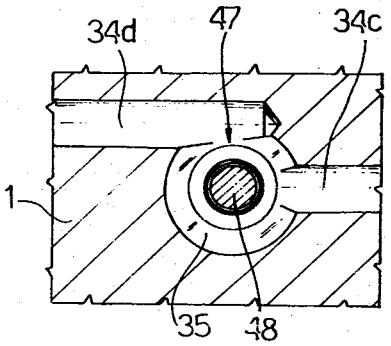
FIG. 5 is a section through the regulator of FIG. 1 taken on the line V—V, and arranged to illustrate a detail of the regulator.

When the slide valve 22 is in the axial position of FIG. 3, which is obtained by moving said stem towards the right from the rest position of FIG. 2, a first duct is arranged to put the first cavity 30 into hydraulic communication with the utilisation chamber 4. This first duct comprises substantially bores 34*a*, 34*b*, 34*c* (FIG. 1), an annular compartment 35 (FIGS. 5 and 1), bores 34*d*, 34*e*, 34*f* (FIG. 1), the annular chamber 25 (FIG. 3), a radial bore 36, an axial bore 37 and a radial bore 38, all provided in the stem 22 and in communication with each other.

Obviously the first said duct is completely open when the slide valve 23 is in the configuration of FIG. 3, i.e. in which the stem 22 is moved towards the right from its rest configuration of FIG. 2 to a sufficient extent to bring the bore 36 substantially into the chamber 25, as shown in FIG. 3. In contrast, in the rest configuration of FIG. 2, this duct is closed because the active surface 24*a* of the slide valve prevents communication between the chamber 25 and bore 36. The pressure acting in the utilisation chamber 4 can be transmitted through said first duct to the first cavity 30, to act on the first active surface 32.

The regulator also comprises a second duct arranged to put said second cavity 31 into communication with said feed chamber 2. Said duct comprises substantially bores 44*a* (FIG. 1), 44*b* and 44*c*, all provided in the body 1. Communication between the feed chamber 2 and the bore 44*c* of the second duct is controlled by a bore 45 of a bushing 45*a*. The purpose of this bore, which has a fairly small predetermined diameter, is to reduce in a controlled manner the pressure of the fluid passing from the feed chamber 2 to the said second duct.

The said first and second ducts are in communication with each other by way of a third duct, which is indicated by 46 and is substantially in the form of a single bore which connects the bore 44*c* to the annular compartment 35 (FIGS. 5 and 1) lying between the bores 34*c* and 34*d*. An interception member, which is constituted in the illustrated embodiment by a ball valve 47, is disposed in said third duct 46. The position of this ball relative to its seat is controlled by the stem 48 of a solenoid valve 49, which is able to continuously vary the flow through said third duct 46.

Figure 4:
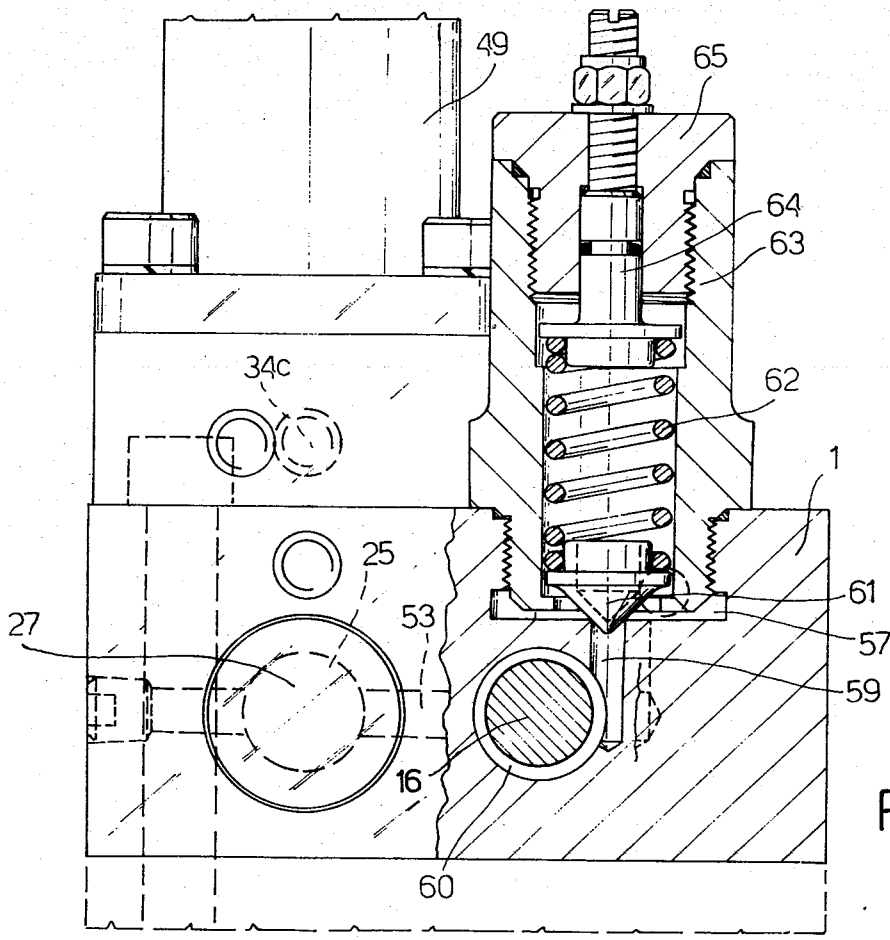
FIG. 4 is a section through the regulator of FIG. 1 on the line IV—IV.

The discharge chamber 5 communicates with the annular chamber 26 by way of a bore 52 (FIG. 2) in the body 1, and the annular chamber 25 communicates through a bore 53 with a further annular chamber 54 formed around the element 7 of the discharge valve 6 and communicating with the interior of the element 7 by way of a radial bore 55. The discharge chamber 5 communicates by way of a bore 56 provided in the body 1, with a cavity 57 (FIG. 4) also provided in the body 1. This chamber can be connected through a bore 59 to a chamber 60 (FIG. 2) communicating with the bore inside the element 7. The passage between the cavity 57 and bore 59 is controlled by a valve element 61 provided with a substantially conical active surface kept in contact with a corresponding seat in the bore 59 by the action of a spring 62 housed in a housing 63. The force exerted by this spring can be adjusted by means of a stem 64 which can be moved axially relative to a bush 65 rigid with the housing 63.

The operation of the described flow regulator is as follows.

It will be assumed that the regulator is connected between a pressure-generating fluid source feeding a flow to the chamber 2, and a user device hydraulically connected via bores, not shown, to the utilisation chamber 4. When the device is in its rest position, the solenoid valve 49 (FIG. 1) is de-energised, and thus the relative stem 48 applies no force to the ball of the interception member 47, which is free to move from its seat in order to open the said third duct 46, which connects the bore 44*c* to the compartment 35, which pertain to the second and first said ducts respectively.

Under these conditions, the fluid reaching the feed chamber 2 (FIGS. 1 and 2) through the bore 45 of the bushing 45*a* enters the bore 44*c* of the second duct. Because only a small fluid flow rate can pass through the bore 45 and with a high pressure drop due to the small bore diameter, the pressure of the fluid entering the bore 44*c* of the second duct is less than that of the fluid in the feed chamber 2. From the aforegoing, as the ducts downstream of the bore 45 of the bushing 45*a* are in communication with the discharge, the fluid reaching the cavity 31 from said bore through the bores 44*b* and 44*a* of the second duct to act on the second active surface 33 of the stem 22 is also at the discharge pressure $p_o$ (close to atmospheric pressure). Thus, the fluid which reaches the first cavity 30 through the bores 46, the annular compartment 35, and the bores 34*c*, 34*b*, 34*a* to act on the first active surface 32 of the stem 22 are also substantially at the same discharge pressure $p_o$. It is therefore apparent that under these conditions, the stem 22 becomes disposed in its left hand end-of-stroke configuration as shown in FIG. 2 because the pressures acting on its end surfaces 32 and 33 are substantially both the same as the atmospheric pressure $p_o$, and therefore generate on the same stem substantially equal and opposite axial forces, the resultant applied to said stem therefore being equal to the force generated by the spiral spring 28, which tends to keep the stem against the end plug 27.

In this configuration, the active surface 20 of the valve element 18 completely closes the orifice 21 between the feed chamber 2 and utilisation chamber 4, so preventing the fluid from flowing towards the user device.

In the same configuration (stem 22 in its left hand end-of-stroke position), the slide valve 23 substantially connects together the two annular chambers 25 and 26 by way of the annular compartment lying between the surfaces 24c, 24d, and thus connects the annular chamber 25 to the discharge chamber 5 by way of the bore 52 (FIG. 2). Consequently, the fluid which passes through the third duct (bore 46) to the annular compartment 35 and from here through the bore 34d of said first duct, can leave this latter bore to pass into the discharge chamber 5 by way of the bores 34e, 34f, the chambers 25 and 26 and the bore 52. The energy loss arising due to the fluid fed to discharge in this manner is very low, because in the said rest configuration the fluid flow rate which passes through the bore 45 to discharge in the manner described is very small, and the fluid pressure is very low.

In the described rest configuration, the cavity in the element 7 of the discharge valve 6 (together with the chamber 60 in communication with said cavity) is connected to the discharge chamber 5 through the bore 55, the annular chambers 25 and 26 and the bore 52, as is clearly seen in FIG. 2. Under these conditions, the force which keeps said valve closed is only that generated by the spiral spring 14, which can have its value set to allow opening of the valve when a predetermined set pressure $p_t$ is reached. It therefore follows that the entire flow provided by the energy source passes to discharge after said set pressure $p_t$ (conveniently low) is reached.

In order to feed a predetermined flow rate to the user device, the solenoid valve 49 (FIG. 1) is energised in order to oppose the movement of the ball of the valve 47 and thus partly close the third duct 46. In this manner, by reducing the flow of fluid through said duct, the pressure of the fluid in the second duct (bores 44b and 44a) tends to increase so that it approximates to the value of the set pressure $p_t$. In this manner, a control pressure $p_c$ greater than the discharge pressure $p_o$ is generated in said duct, and is transmitted to the second cavity 31 to act on the second active surface 33, while the pressure in the bores 34c, 34b, 34a of the first duct tends to remain substantially equal to the discharge pressure $p_o$. It is therefore apparent that under these conditions, the said control pressure $p_c$ and the discharge pressure $p_o$ act on the two active surfaces of the stem 33 and 32 respectively, and as the former is greater than the latter, the resultant applied to the stem tends to move it towards the right in FIG. 2, overcoming the resilient reaction generated by the spiral spring 28. The stem therefore moves into the configuration shown in FIG. 3, in which the active surface 20 of the valve element 18 frees the passage through the orifice 21 to an adjustable extent, to put the feed chamber 2 into communication with the utilisation chamber 4, and thus feed a predetermined fluid flow rate to the user device. This flow rate varies linearly with the passage cross-section through the orifice 21, as the pressure difference between the feed chamber 2 and utilisation chamber 4 is kept constant (and equal to the value $p_t$ of the discharge valve 6 as described hereinafter). The slide valve 23 simultaneously moves into the configuration of FIG. 3, in which the bore 36 becomes located in the annular chamber 25, and the active surface 24a substantially closes the passage between the annular chambers 25 and 26.

When the stem 22 has reached the new position indicated, the utilisation chamber 4 is put into communication with the second cavity 30 by way of the aforesaid first duct. In this respect, the fluid can pass from the utilisation chamber 4, through the bores 38 (FIG. 3), 37 and 36 of the stem 22, and into the annular chamber 25, and from here it can pass through the bores 34f (FIG. 1), 34e and 34d into the annular compartment 35, to be able to pass from this latter through the bores 34c, 34b and 34a into the first cavity 30. In this configuration, which can therefore be considered the normal operating configuration of the regulator, the utilisation pressure $p_u$ acts on the first active surface 32 of the stem 22, while the control pressure $p_c$ acts on the second active surface 33, the value of this latter pressure being able to be suitably adjusted to a pressure level between the pressure $p_a$ of the feed chamber and the pressure $p_u$ of the utilisation chamber by varying the passage port through the valve 47. While the utilisation pressure $p_u$ is substantially constant in any given operating condition of the user device, the control pressure $p_c$ can be varied in the required manner by varying the said interception member. It follows that the value of the resultant applied to the stem 22, and which determines its axial movement, depends on the control pressure $p_c$ and thus on the degree of restriction of fluid flow through the third duct 46 by the valve 47.

When the regulator is in the working configuration of FIG. 3, the cavity in the element 7 (FIG. 3) of the discharge valve 6 is in communication not with the discharge as in the previous rest configuration, but directly with the utilisation chamber 4 by way of the bores 55, 53, the annular chamber 25 and the bores 36, 37 and 38 of the stem 22. The force necessary under these conditions to open said valve, and therefore to discharge the fluid from the feed chamber 2 to the discharge chamber 5, is generated by the resilient force of the spring 14 plus the force produced by the utilisation pressure $p_u$, which is in the same direction as the preceding. In other words, said valve can now be opened only when the difference between the force generated by the feed pressure $p_a$ and the force generated by the utilisation pressure $p_u$ exceeds the resilient force of the spring 14, so that $p_a = p_u + p_t$.

In this manner, the force necessary to open the discharge valve 6 tends to increase as the utilisation pressure $p_u$ increases, with the advantage that this force is scaled to the effective operating conditions of the user item, with the result that the energy losses through the discharge chamber 5 are reduced to a minimum.

It is therefore apparent that flow regulation carried out by the regulator according to the invention is accompanied by very small energy losses. In this respect, during the first operating stage of the regulator when it passes from the configuration of FIG. 2 to that of FIG. 3 by closing the interception member 47, there is only a small loss of hydraulic fluid towards the discharge chamber 5 (through the bores 45, 46, 34d, 34e, 34f, the annular chambers 25, 26 and the bore 52) over a very short time period and with a very low fluid pressure. When the device is operating under normal conditions corresponding to configurations analogous to that of FIG. 3, there is substantially no energy loss while controlling the movement of the stem 22, because the fluid used for controlling the stem 22 is returned to circulation from the chamber 35, through the ducts 34d, 34c and 34f, the chamber 25, the bore 36, the duct 37 and the bore 38, to the user item.

The valve element 61 (FIG. 4) which closes the bore 59 and is loaded by the spiral spring 62, constitutes a safety valve which prevents excessive pressures being attained in the chamber 60. Said valve element is lifted, overcoming the resilient reaction of the relative spring 62, when a required pressure is attained in the chamber 60, to discharge the fluid firstly into the cavity 57 and then from here through the bore 56 into the discharge chamber 5.

It is apparent that modifications can be made to the described and illustrated embodiment of the present invention, both in its form and in the arrangement of the various parts, without leaving the scope of the inventive idea.

What we claim is:

1. A flow regulator designed to control the flow of a pressurized fluid between a source of said fluid which feeds it at a feed pressure, and a user device in which said fluid is at a utilization pressure which depends on the operating conditions of the device, comprising: a body in which there is provided a feed chamber and a utilization chamber, a discharge valve arranged to open and to feed towards a discharge chamber at least part of said fluid from said source when the difference between said feed pressure and said utilization pressure exceeds a given value, a valve element mobile in the direction of its axis which is arranged to vary the degree of closure of an orifice between said feed chamber and said utilization chamber of said body and is kept normally by the action of a spring in a rest position in which it closes said orifice, a first and second cavity in which a first and a second active surface of said valve element are respectively housed, each active surface being arranged to sense a pressure acting on it and to determine a corresponding axial movement of said valve element, said first cavity being in communication with said utilization chamber by way of a first duct in order to cause said utilization pressure to act on said first active surface of the valve element and said second cavity being in communication with said feed chamber by way of a second duct, said first and second ducts being in communication with each other by way of a third duct, and an interception member disposed within said third duct and designed to vary the the flow of said fluid through said third duct, said feed chamber and said second duct being in communication with each other by way of a bore of predetermined size which is arranged to reduce the pressure of said fluid passing from said feed chamber to said second duct, such that the degree of closure of said orifice between said feed chamber and said utilization chamber is varied by adjusting said interception member which varies the flow of said fluid through said third duct and thus generates in said second duct a control pressure which is transmitted to said second cavity and to said second active surface and consequently moves said valve element.

2. A flow regulator as claimed in claim 1, wherein said valve element further comprises a slide valve which, when said valve element is in said rest position, assumes a first position in which a control surface of said slide valve interrupts communication from said first cavity to said utilization chamber through said first duct, and which, when said valve element opens said orifice between said feed chamber and said utilization chamber, assumes at least one second position in which said communication from said first cavity to said utilization chamber through said first duct is open.

3. A regulator as claimed in claim 2, wherein said interception member comprises a ball valve, the opening and closure of which is continuously controlled by an electromagnetic device.

4. A regulator as claimed in claim 2, wherein said discharge valve is kept normally closed by resilient means, and comprises two active surfaces, each of which is arranged to sense a pressure acting on it and to determine a corresponding axial movement of said discharge valve, one of said active surfaces being housed in said feed chamber and the other in a third cavity, said third cavity being arranged to be put into communication with said discharge chamber or with said utilization chamber when said slide valve is in said first or second position respectively.

5. A regulator as claimed in claim 4, wherein said two active surfaces of said discharge valve have equal areas.

6. A regulator as claimed in claim 2, wherein said valve element, said slide valve and said first and second active surfaces of said valve element are provided on portions of a cylindrical stem which is mobile in the direction of its axis in said body.

7. A regulator as claimed in claim 6, wherein said discharge valve is disposed in said body with its axis substantially parallel to the axis of said cylindrical stem.

8. A regulator as claimed in claim 7, wherein said first duct is formed by a first set of bores provided in said body and in said cylindrical stem, and by annular chambers provided in said body around portions of said cylindrical stem.

9. A regulator as claimed in claim 8, wherein said second duct is formed by a second set of bores provided in said body.

10. A regulator as claimed in claim 9, wherein said third duct is formed by a bore which connects one bore of said first set of bores to one bore of said second set of bores, said interception member being disposed within said third duct.

* * * * *